US007621802B2

(12) United States Patent
McCarthy

(10) Patent No.: US 7,621,802 B2
(45) Date of Patent: Nov. 24, 2009

(54) CORNER SANDING SPONGE

(75) Inventor: Kevin J. McCarthy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 387 days.

(21) Appl. No.: 10/227,713

(22) Filed: Aug. 26, 2002

(65) Prior Publication Data

US 2004/0038634 A1 Feb. 26, 2004

(51) Int. Cl.
*B24D 11/00* (2006.01)

(52) U.S. Cl. ..... 451/523; 451/533

(58) Field of Classification Search ..... 451/526, 451/528–530, 533, 523
See application file for complete search history.

(56) References Cited

U.S. PATENT DOCUMENTS

| | | | | |
|---|---|---|---|---|
| 1,062,214 | A | 5/1913 | Bergman | |
| 1,570,177 | A | 1/1926 | Pointer | |
| 1,595,700 | A | 8/1926 | Backlind | |
| 1,782,577 | A | 11/1930 | Maris | |
| 2,030,911 | A * | 2/1936 | Borden | 401/266 |
| 2,112,593 | A | 3/1938 | Campbell | |
| 2,295,823 | A * | 9/1942 | Banigan et al. | 15/244.3 |
| D159,216 | S | 7/1950 | Kuehnert | |
| 2,531,588 | A | 11/1950 | Stuker | |
| 2,817,931 | A | 12/1957 | Houser | |
| 3,034,267 | A | 5/1962 | Feeney | |
| 3,137,880 | A * | 6/1964 | Kubit et al. | 15/244.1 |
| 3,279,130 | A | 10/1966 | Nelson | |
| D211,262 | S | 6/1968 | Theobald | |
| 3,614,845 | A | 10/1971 | Cook | |
| 3,653,859 | A | 4/1972 | Zimmer, Jr. et al. | |
| 3,694,845 | A * | 10/1972 | Engelsher | 15/244.4 |
| 3,699,729 | A | 10/1972 | Garvey et al. | |
| 3,777,444 | A | 12/1973 | Dunn | |
| 3,924,362 | A | 12/1975 | McAleer | |
| 3,998,012 | A | 12/1976 | Ness | |
| 4,202,139 | A | 5/1980 | Hong et al. | |
| 4,263,677 | A | 4/1981 | Menser | |
| 4,263,755 | A | 4/1981 | Globus | |
| 4,501,096 | A | 2/1985 | Lukianoff | |

(Continued)

FOREIGN PATENT DOCUMENTS

| | | |
|---|---|---|
| DE | 226 823 A1 | 9/1985 |

(Continued)

OTHER PUBLICATIONS

Correspondence from David B. Patchett to President, Ali Industries, Inc. dated Feb. 19, 2003.

(Continued)

*Primary Examiner*—Maurina Rachuba
(74) *Attorney, Agent, or Firm*—David B. Patchett

(57) ABSTRACT

A hand held corner sanding sponge includes a backing layer of an open-celled foam material having first and second major surfaces that meet at a right angle and third and fourth major surfaces that meet at a right angle. The cross-sectional dimension between the intersection of the first and second major surfaces from the intersection of the third and fourth major surfaces is about 4 inches to about 6 inches. First and second side surfaces are located between the first and second major surface and the third and fourth major surfaces forming a generally hexagonal shape. The cross-sectional dimension between the first and second side surfaces is about 3 inches to about 4 inches. A layer of flexible adhesive is adhered to at least the first and second major surfaces of the backing layer. A layer of abrasive particles is adhered to the major surfaces by the flexible adhesive.

16 Claims, 6 Drawing Sheets

U.S. PATENT DOCUMENTS

| | | | | | |
|---|---|---|---|---|---|
| 4,525,959 | A | | 7/1985 | Ziebarth et al. | |
| 4,543,751 | A | | 10/1985 | Alikhan | |
| 4,640,060 | A | | 2/1987 | Lukianoff | |
| 4,825,597 | A | | 5/1989 | Matechuk | |
| 4,887,396 | A | | 12/1989 | Lukianoff | |
| D319,766 | S | | 9/1991 | Erickson | |
| 5,054,248 | A | | 10/1991 | Thayer | |
| 5,131,193 | A | | 7/1992 | Demers | |
| 5,134,809 | A | | 8/1992 | Morton et al. | |
| 5,168,663 | A | | 12/1992 | Klocke | |
| 5,177,909 | A | | 1/1993 | Klocke | |
| 5,203,123 | A | | 4/1993 | Travis | |
| D336,027 | S | | 6/1993 | Demers | |
| D340,397 | S | | 10/1993 | Demers | |
| 5,309,681 | A | | 5/1994 | Cheney et al. | |
| 5,313,746 | A | | 5/1994 | Zarriello | |
| 5,316,812 | A | | 5/1994 | Stout et al. | |
| D348,817 | S | | 7/1994 | Demers | |
| 5,337,523 | A | | 8/1994 | Walsh | |
| 5,337,524 | A | * | 8/1994 | Norville | 451/526 |
| D355,105 | S | | 2/1995 | Nemazi | |
| D356,935 | S | | 4/1995 | Demers | |
| D356,936 | S | | 4/1995 | Demers | |
| D357,394 | S | | 4/1995 | Demers | |
| D357,620 | S | | 4/1995 | Demers | |
| 5,417,726 | A | | 5/1995 | Stout et al. | |
| 5,429,545 | A | | 7/1995 | Meyer | |
| 5,533,926 | A | | 7/1996 | Nemazi | |
| D373,715 | S | | 9/1996 | Fink | |
| 5,605,500 | A | | 2/1997 | Matechuk | |
| 5,651,728 | A | | 7/1997 | Stanzione | |
| 5,662,519 | A | | 9/1997 | Arnold | |
| D386,058 | S | | 11/1997 | Schmidt | |
| 5,690,547 | A | | 11/1997 | Holland, Jr. et al. | |
| 5,718,622 | A | | 2/1998 | Jones | |
| 5,759,090 | A | | 6/1998 | Kawate et al. | |
| 5,799,357 | A | * | 9/1998 | Taylor | 15/244.1 |
| 5,849,051 | A | | 12/1998 | Beardsley et al. | |
| 5,849,646 | A | | 12/1998 | Stout et al. | |
| 5,885,148 | A | | 3/1999 | Vargas et al. | |
| 5,895,316 | A | | 4/1999 | Williams | |
| 5,915,869 | A | * | 6/1999 | Agosto et al. | 401/201 |
| 5,954,571 | A | | 9/1999 | Case | |
| 6,059,850 | A | * | 5/2000 | Lise et al. | 51/297 |
| 6,120,365 | A | | 9/2000 | Johnson | |
| 6,196,909 | B1 | | 3/2001 | Cadrobbi | |
| 6,227,959 | B1 | | 5/2001 | Beaudry | |
| 6,383,064 | B1 | | 5/2002 | Eggert et al. | |
| 6,419,573 | B1 | * | 7/2002 | Lise et al. | 451/533 |
| 6,439,988 | B1 | * | 8/2002 | Long et al. | 451/495 |
| 6,524,175 | B2 | | 2/2003 | Beaudry et al. | |
| 6,601,591 | B1 | * | 8/2003 | Carullo et al. | 132/320 |
| D480,619 | S | | 10/2003 | Koenig, Jr. | |
| 2001/0029967 | A1 | * | 10/2001 | McDonough | 134/6 |
| 2003/0208866 | A1 | * | 11/2003 | Parks | 15/118 |

FOREIGN PATENT DOCUMENTS

| | | | |
|---|---|---|---|
| DE | 37 00 990 | A1 | 7/1988 |
| DE | 37 25 656 | A1 | 2/1989 |
| DE | 37 31 236 | A1 | 3/1989 |
| DE | 42 10 819 | C1 | 6/1993 |
| DE | 296 12 820 | U1 | 2/1997 |
| DE | 298 13 386 | U1 | 1/1999 |
| EP | 0 103 560 | A2 | 3/1984 |
| EP | 0 635 335 | A1 | 1/1995 |
| GB | 2 114 028 | A | 8/1983 |
| GB | 2 245 511 | A | 1/1992 |
| GB | 2 256 383 | A | 12/1992 |
| GB | 2 299 038 | A | 9/1996 |
| GB | 2 327 899 | A | 2/1999 |
| JP | 59-5231 | | 1/1984 |
| JP | 60-20865 | | 2/1985 |
| JP | 61-124373 | | 8/1986 |
| JP | 10-235565 | | 9/1998 |
| WO | WO 89/08008 | | 9/1989 |
| WO | WO 90/01398 | | 2/1990 |
| WO | WO 94/13435 | | 6/1994 |
| WO | WO 97/34735 | | 9/1997 |

OTHER PUBLICATIONS

Correspondence from R. William Graham to David B. Patchett dated Feb. 26, 2003.
Correspondence from David B. Patchett to R. William Graham dated Mar. 3, 2003.
Correspondence from Roger J. Makley to David B. Patchett dated Mar. 17, 2003 with Ali Industries, Inc. product literature attached.
Correspondence from David B. Patchett to Roger J. Makley dated Mar. 25, 2003.
Home Improvement Center literature, Dec. 1992.
Home Improvement Center literature, Oct. 1992.
Norton website literture, May 2002.
REMPAC Foam Corporation website literature, May 2002.
Johnson Abrasives Co., Inc. website literature (2 articles), May 2002.
Abrapower website literature (2 articles), May 2002.

* cited by examiner

CORNER SANDING SPONGE

FIELD OF THE INVENTION

The present invention relates to resilient flexible abrading devices typically referred to as sanding sponges, and more particularly, to a hand-sized, disposable sanding sponge for sanding a variety of surface shapes and configurations.

BACKGROUND OF THE INVENTION

Common sanding jobs calling for considerable detail work or access to small confined areas, or for the sanding of contoured surfaces, will often require that the surfaces be hand sanded. Heretofore, hand-held sanding devices for this purpose consist essentially of a sanding block for holding conventional sandpaper wrapped over the block. By using a sanding block as a sandpaper holder, hand-applied sanding forces on the sandpaper can be increased and more evenly distributed.

The difficulty with the above-mentioned prior sanding devices is the necessity of installing or wrapping a separate piece of sandpaper around the device. This installation or wrapping process presents some inconvenience to the user. For example, if the paper is improperly installed, it is susceptible to falling off. Also, the device requires the purchase of separate sheets of sandpaper that is a further inconvenience in terms of the amount of supplies needed.

U.S. Pat. No. 4,887,396 (Lukianoff) discloses a hand-sized sanding device that eliminates the need for a separate sheet of sandpaper. The sanding device is provided with its own integral abrasive surfaces that can be manufactured at a sufficiently low cost to be disposable. The sanding device of Lukianoff can be conveniently used off-the-shelf to hand sand a variety of standard, contoured or shaped surfaces, such as trim or molding surfaces, and for projecting into exactly defined areas.

Another type of sanding device is the resilient flexible sanding sponge. Sanding sponges generally include a layer of abrasive particles adhered to a foam backing by a flexible adhesive. One such sanding sponge is commercially available from Minnesota Mining and Manufacturing Company, St Paul, Minn. under the trade designation "Softback Sanding Sponge". Typically, a user places the backing layer against the palm of his or her hand and rubs the abrasive over a surface to be abraded. The flexible adhesive layer and the foam backing permit the layer of abrasive to conform to the surface being abraded.

While such sanding sponges work quite well to abrade objects having flat surfaces, the foam backing and/or the flexible adhesive layer is often torn when they are used to abrade the intersecting surfaces of projections such as the corners of a table top. Hand pressure on the sanding sponge can cause such a projection to penetrate and tear the backing layer of the sanding, sponge as it is moved over the projection. A sanding sponge with high tear strength backing layer is disclosed in U.S. Pat. No. 6,419,573 (Lise et al.).

One specialty sanding sponge is the corner sanding sponge is a compressible sponge of an open-celled foamed polyurethane. The sponge has first and second planar surfaces that meet at a right angle. The first and second planar surfaces are coated with an abrasive material. The portion of the sponge enclosed between the first and second surfaces includes a grasping means forming an integral portion of the sponge.

BRIEF SUMMARY OF THE INVENTION

The present invention relates to a hand held corner sanding sponge. The corner sanding sponge includes a backing layer of an open-celled foam material having first and second major surfaces that meet at a right angle and third and fourth major surfaces that meet at a right angle. The cross-sectional dimension between the intersection of the first and second major surfaces from the intersection of the third and fourth major surfaces is about 4 inches to about 6 inches. First and second side surfaces are located between the first and second major surface and the third and fourth major surfaces forming a generally hexagonal shape. The cross-sectional dimension between the first and second side surfaces is about 3 inches to about 4 inches. A layer of flexible adhesive is adhered to at least the first and second major surfaces of the backing layer. A layer of abrasive particles is adhered to the major surfaces by the flexible adhesive. The backing layer can optionally be a felted foam.

In one embodiment, the layer of flexible adhesive and the layer of abrasive particles extend along at least one of the first and second side surfaces. Alternatively, the layer of flexible adhesive and the layer of abrasive particles extend along both of the first and second side surfaces.

In another embodiment, at least one of the first and second side surfaces comprises a concave cross-sectional shape. Alternatively, the first and second side surfaces both comprise a concave cross-sectional shape.

Depending upon the open-celled foam used, the layer of flexible adhesive comprises a major portion below the major surfaces of the backing layer and a minor portion comprising meniscuses of the adhesive around the abrasive particles, thereby exposing a high percentage of the abrasive particles for contact with a surface to be abraded In one embodiment, the cross-sectional dimension between the intersection of the first and second major surfaces from the intersection of the third and fourth major surfaces is about 5 inches. The cross-sectional dimension for the same corner sanding sponge between the first and second side surfaces is about 3½ inches.

BRIEF DESCRIPTION OF THE SEVERAL VIEWS OF THE DRAWING

The present invention will be further described with reference to the accompanying drawing wherein like reference numerals refer to like parts in the several views, and wherein.

DETAILED DESCRIPTION OF THE INVENTION

Figure 1:
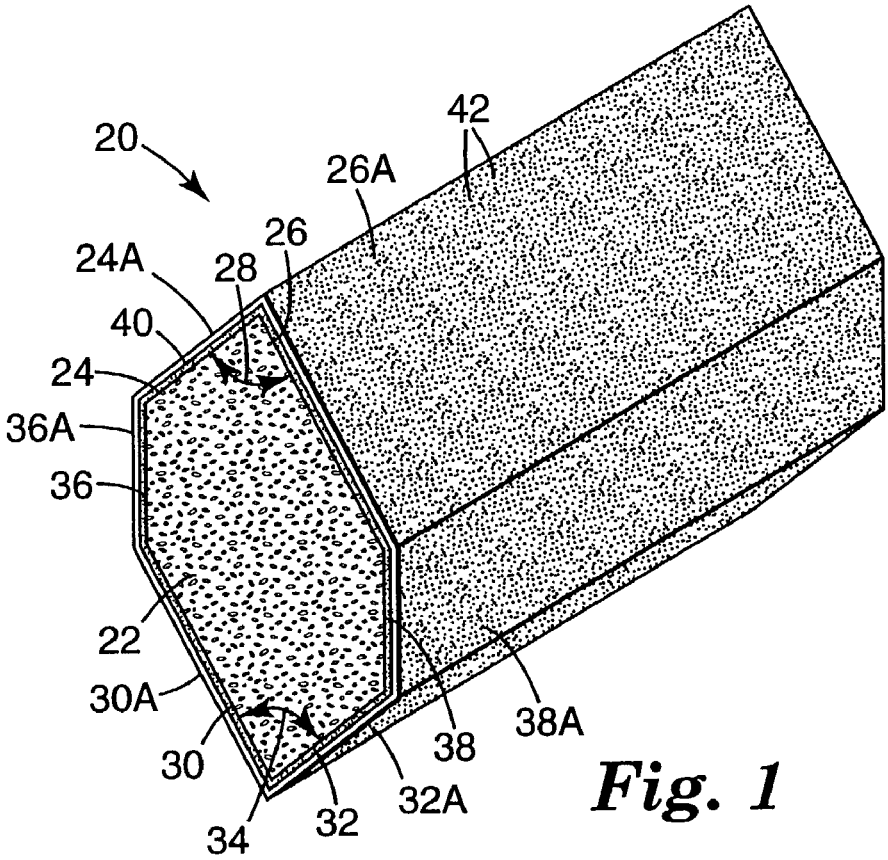
FIG. 1 is a perspective view of a first embodiment of a corner sanding sponge according to the present invention.
Figure 2:
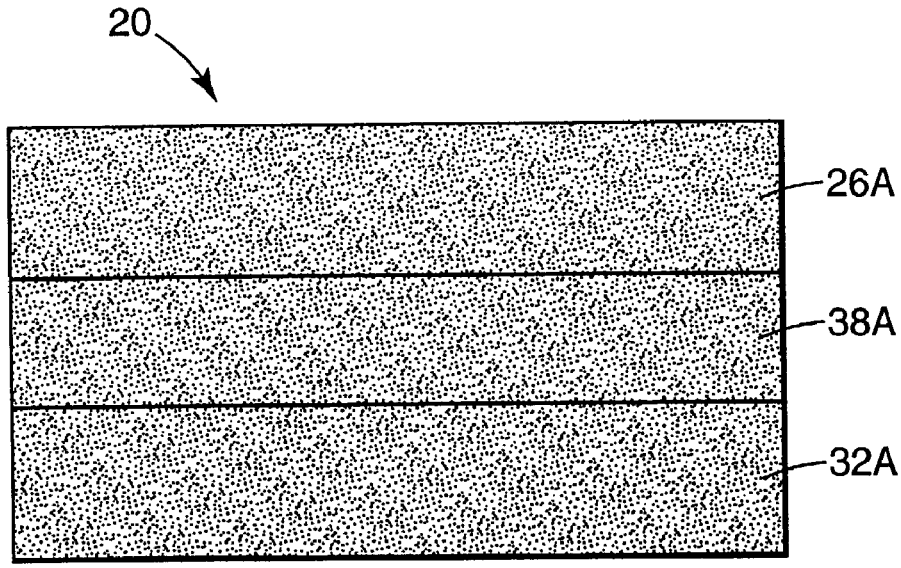
FIG. 2 is a side plan view of the sanding sponge of FIG. 1.
Figure 3:
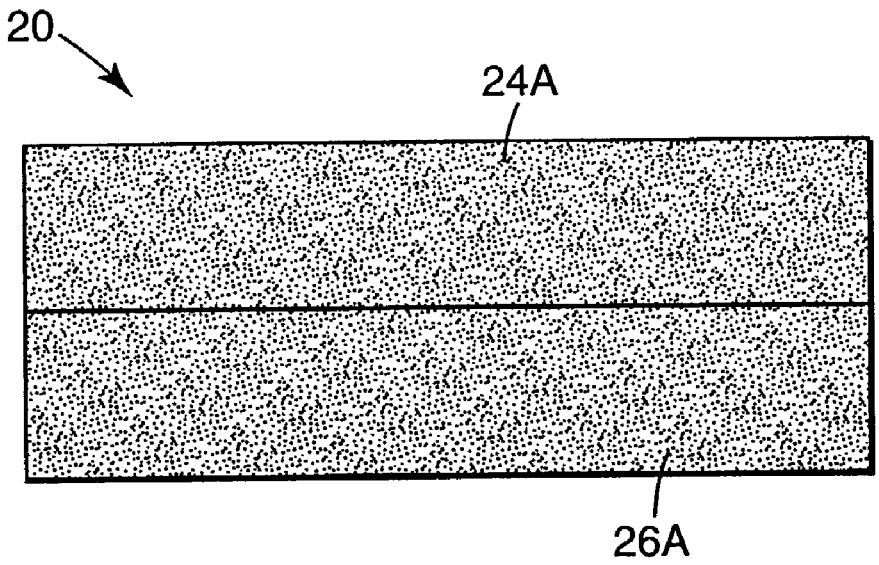
FIG. 3 is a top plan view of the sanding sponge of FIG. 1.
Figure 4:
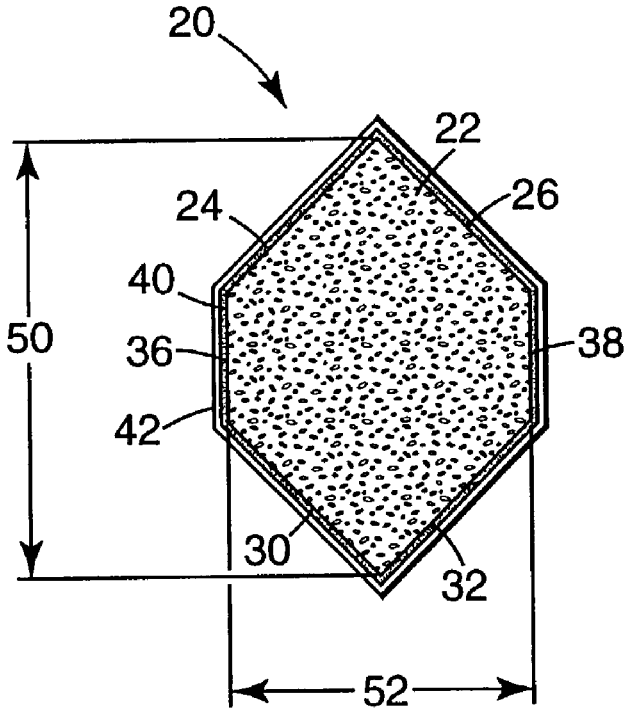
FIG. 4 is an end plan view of the sanding sponge of FIG. 1.

FIGS. 1-4 illustrate the first embodiment of a resilient flexible corner sanding sponge 20 according to the present invention. The corner sanding sponge 20 includes a backing layer 22 of an open celled foam material. The backing layer 22 is configured to have a first pair of major surfaces 24, 26 that meet at a right angle 28 and a second pair of major surfaces 30, 32 that meet at a right angle 34. A pair of coplanar, opposing side surfaces 36, 38 are located between the pairs of major surfaces 24, 26 and 30, 32, forming a generally hexagonal cross-section.

A flexible adhesive 40 is used to adhere a layer of abrasive particles 42 to at least the major surfaces 24, 26 of the backing layer 22. In the preferred embodiment, a layer of abrasive particles 42 is adhered to all four major surfaces 24, 26, 30, and 32. A layer of abrasive particles 42 can optionally be adhered to the side surfaces 36, 38.

The flexible adhesive 40 must bond the layer of abrasive particles 42 to the backing layer 22 and adheres the abrasive particles 42 together and to that backing layer 22 while being sufficiently flexible to conform with the backing layer 22 to the contour of surfaces to be abraded by the sanding sponge 20. A flexible adhesive formulation and method of applying it described in U.S. Pat. No. 6,059,850 can be used to form the layer of flexible adhesive 40.

A layer of hard anti-loading size coating can optionally extend over the flexible adhesive 40 and the abrasive particles 42 opposite the backing layer 22. A hard anti-loading size coating formulated and applied using the method described in U.S. Pat. No. 6,059,850 is suitable for this purpose.

In some embodiments, a major portion of the flexible adhesive 40 extends below the major surfaces 24, 26, 30, 32, 36, and 38 of the backing layer 22. By "major portion" we mean that more than half the thickness of the flexible adhesive 40 is below the major surfaces 24, 26, 30, 32, 36, and 38 of the backing layer 22. We estimate from observation that about 60 to 80 percent of the thickness of the layer of flexible adhesive 40 is below the major surfaces 24, 26, 30, 32, 36, and 38 of the backing layer 22. That major portion of the layer of flexible adhesive 40 below the major surfaces 24, 26, 30, 32, 36, 38 of the backing layer 22 is firmly adhered to the cell walls of the foam backing layer 22 and has very few voids that could weaken its structural integrity. Thus, that major portion of the layer of flexible adhesive 40 below the major surfaces 24, 26, 30, 32, 36, 38 of the backing layer 22 together with the minor portion of the layer of flexible adhesive 40 above the surface 44 of the backing layer 22 provides the needed integrity so that the layer of flexible adhesive 40 will not break as it is flexed to conform to a surface as the sanding sponge 20 is used.

Wicking of the flexible adhesive 40 into the foam backing 22 causes the flexible adhesive 40 to draw back from around the abrasive particles 42, while leaving meniscuses of the adhesive around the abrasive particles 42 to hold them in place. Consequently, a high percentage of the abrasive particles 42 are exposed for contact with a surface to be abraded. Also, that wicking of the flexible adhesive 40 into the backing layer 22 causes most of the abrasive particles 42 to become supported closely along the major surfaces 24, 26, 30, 32, 36, 38 of the backing layer 22, rather than having abrasive particles 42 supported on portions of the layer of flexible adhesive 40 of different thicknesses. Consequently, outer surfaces 24A, 26A, 30A, 32A, 36A, 38A of the sanding sponge 20 defined by the ends of the abrasive particles 42 are almost as smooth as the corresponding major surfaces 24, 26, 30, 32, 36, 38 of the backing layer 22.

In one embodiment, the backing layer 22 is constructed from a high tear strength felted urethane foam. The felted urethane foam used for the backing layer 22 is formed by compressing one or more layers of heated urethane foam (a thermoplastic foam) in a first direction to reduce the thickness of the layers and provide a desired density for the foam. Felted polyurethane foam is available from Crest Foam Industries, Inc., Moonachie, N.J., in a range of compression ratios at least including from 2 to 10 (i.e., the compression ratio of the felted foam is the ratio of the thickness of the foam before it is compressed to the thickness of the foam after it is compressed).

Non-reticulated felted urethane foam having a compression ratio of 3 (e.g., felted urethane foam obtained from Crest Foam Industries, Inc., Moonachie, N.J., under the trade designation "Felt 7018 NAT N/R 0.3450/0.118.times.46.times.56") has been found to work well as the backing layer 22 of the sanding sponge 20. This non-reticulated foam provides the desired combination of softness and tear strength while allowing or causing the major structurally sound portion of the flexible adhesive 40 to be formed below its surface 44, apparently by wicking the flexible adhesive 40 when it is applied as a liquid into several layers of cells below the major surfaces 24, 26, 30, 32, 36, 38 of the backing layer 22.

Felted foams having other lower or higher compression ratios (e.g., 2, 4, or 5) may also be useful. Felted urethane foams with lower compression ratios are more flexible and less expensive than those with a compression ratio of 3 but offer less tear resistance and may not as readily wick in the flexible adhesive 40. Presumably the tear resistance and ability to wick in a major structurally sound portion of the flexible adhesive 40 increases for felted urethane foams with higher compression ratio numbers, but such felted urethane foams also become more stiff and more expensive as their compression ratios increase. Other open cell foams suitable for the present invention are available from Mercury Foam of Clifton, N.J. under product designation 912-CDS and 912-CSS.

The abrasive particles 42 can be any of the abrasive particles described in U.S. Pat. No. 6,059,850, particularly including particles of aluminum oxide, ceramic, or silicon carbide in the range of about 36 to 400 grit.

In another embodiment, the backing layer 22 is constructed from a reinforced foam including a strong reinforcing material, such as for example separate metal or polymeric fibers (e g., nylon) or a porous layer of attached non-woven metal or polymeric fibers, or woven metal or polymeric strands (e.g., window screen) that increases the strength and tear resistance of the foam cast around it. One such reinforced polyurethane foam, available from Fulflex, Inc., Middletown, R.I., under the trade designation "Polycryl 500" which appears to be reinforced by fine denier fibers has been found to work well as the backing layer 22 of the sanding sponge 20.

Sanding sponges are typically made by coating a liquid adhesive over one or more surfaces of the backing layer 22, coating a layer of the abrasive particles 42 on the adhesive coated surface of the backing layer 22, and then drying the flexible adhesive 40. When the backing layer 22 is of felted foam, more of that layer of coat flexible adhesive 40 will be wicked into and adsorbed in the backing layer 22 than when the backing layer is a layer of non-felted urethane foam, apparently because of the smaller cell size and crushed cell walls of the felted foam.

This greater adsorption of the flexible adhesive 40 has several desirable effects. First, it forms a major layer of flexible adhesive below the surface of the backing layer 22 along which the layer of abrasive particles 42 is adhered. Second, wicking of the coat adhesive into the felted urethane foam backing material causes the adhesive to draw backing from around the abrasive particles 42 while leaving meniscuses of the adhesive around the abrasive particles to hold them in place. These meniscuses of adhesive expose a higher percentage of the abrasive particles for contact with a surface to be abraded than is exposed if less of the coat adhesive is wicked into the backing layer. Wicking of the coat adhesive into the felted urethane foam backing material also appears to cause most of the abrasive particles 42 to become supported closely along the major surfaces 24, 26, 30, 32, 36, 38 of the backing layer 22 (rather than having some abrasive particles 42 supported on portions of the layer of flexible adhesive 40 of different thicknesses as appears to be the case with prior art sanding sponges).

The backing layer 22 preferably has a cross section of such size that fits comfortably in the palm of the user's hand with the fingers and thumb engagin the sides surfaces 36, 38. The backing layer 22 preferably has a cross-sectional dimension between side surfaces 36, 38 along minor axis 52 of about 7.62 centimeters (3 inches) to about 10.16 centimeters (4 inches), and preferably about 8.89 centimeters (3.5 inches).

The backing layer 22 preferably has a cross-sectional dimension along major axis 50 such that the fingers of the user's hand will not reach to or beyond the bottom of the backing layer 22 and thereby greatly reduce the chances of the user's fingers being injured in moving the sanding sponge 20 back and forth in use. The major axis 50 extends from the intersection of the major surfaces 24, 26 to the major surfaces 30, 32. The major axis 50 is preferably about 10.16 centimeters (4 inches) to about 15.24 centimeters (6 inches) in length, and more preferably about 127 centimeters (5 inches) in length.

In one embodiment, the major surfaces 26, 28, 30, 32 have a cross-sectional dimension of about 6.35 centimeters (2.5 inches) and the side surfaces have a cross-sectional dimension of about 3.81 centimeters (1.5 inches). This combination of dimensions results in a major axis about 12.7 centimeters (5 inches) long and a minor axis of about 8.89 centimeters (3.5 inches).

The backing layer 22 is preferably resiliently crushable (i.e., indentable) when squeezed by the thumb and fingers of the user's hand and thus is not likely to slip from and injure the hand even if the fingers are wet or greasy. The backing layer 22 being cellular foam is somewhat resiliently axially compressible and acts as a cushion between the user's hand and the work as the sanding sponge 20 is being pushed back and forth to perform the abrading function.

Figure 5:
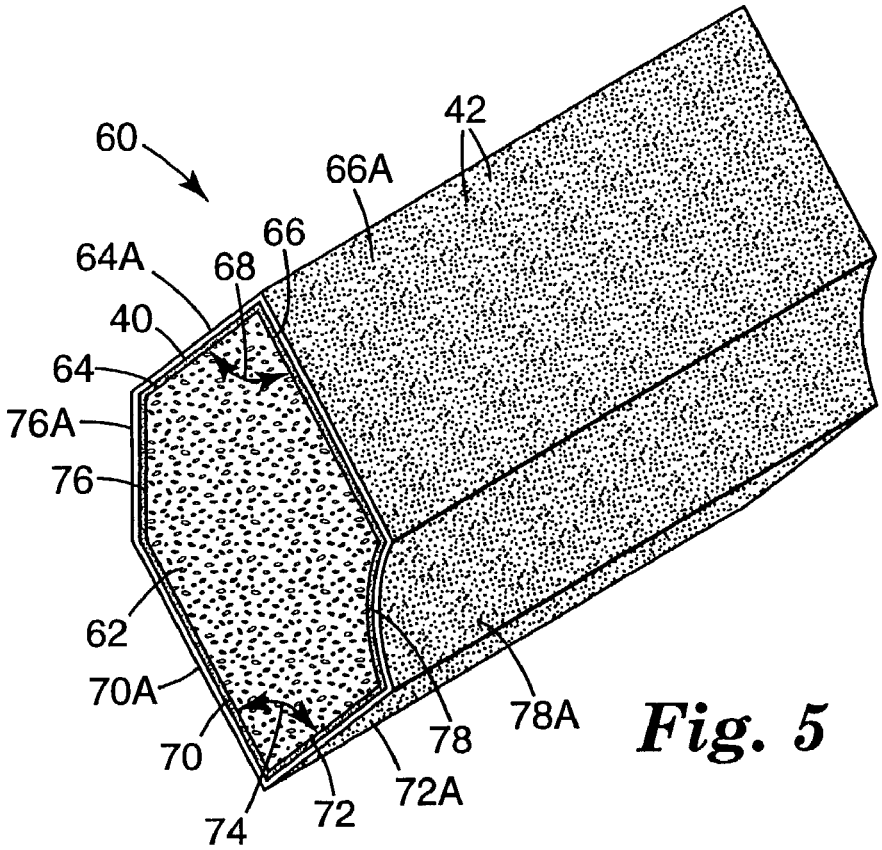
FIG. 5 is a perspective view of a second embodiment of a corner sanding sponge according to the present invention.
Figure 6:
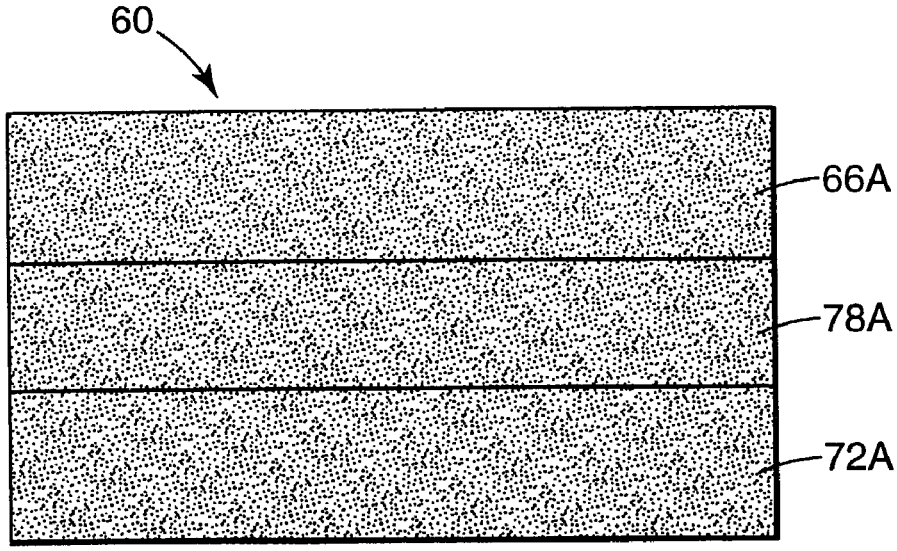
FIG. 6 is a side plan view of the sanding sponge of FIG. 5.
Figure 7:
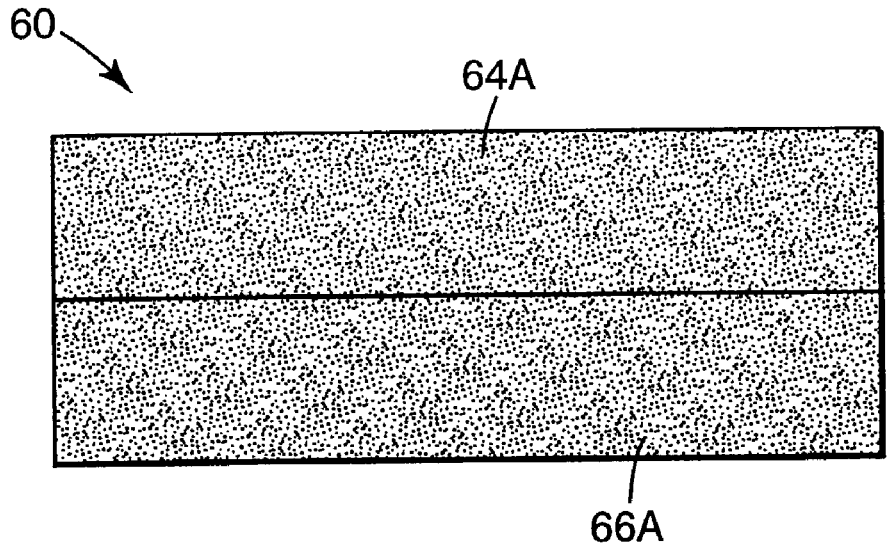
FIG. 7 is a top plan view of the sanding sponge of FIG. 5.
Figure 8:
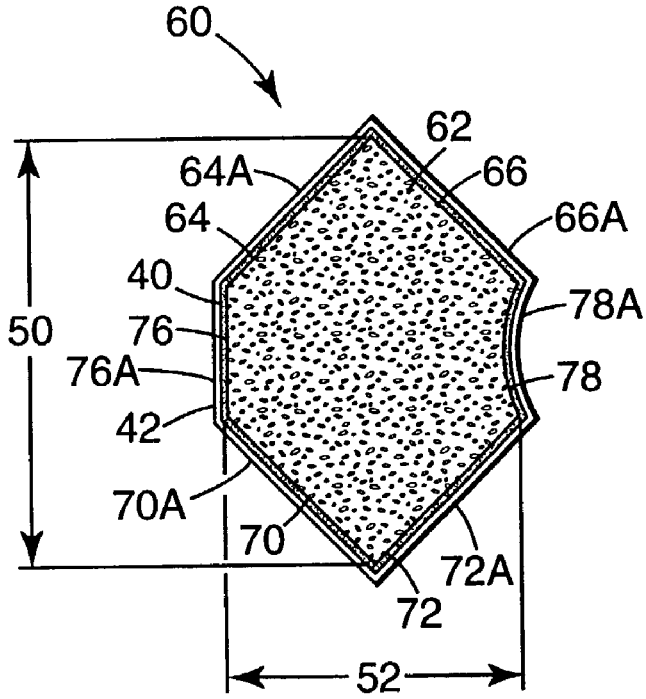
FIG. 8 is an end plan view of the sanding sponge of FIG. 5.

FIGS. 5-8 illustrate a second embodiment of the corner sanding sponge 60 of the present invention. Backing layer 62 is configured to have a first pair of major surfaces 64, 66 that meet at a right angle 68 and a second pair of major surfaces 70, 72 that meet at a right angle 74. A pair of opposing side surfaces 76, 78 are located between the pairs of major surfaces 64, 66 and 70, 72 as in FIG. 1, except that side surface 78 is convex. If an imaginary line is drawn between the corners 80, 82 along the edges of the side surface 78, the cross section of the sanding sponge 60 is generally hexagonal.

The flexible adhesive 40 is used to adhere the layer of abrasive particles 42 to at least the major surfaces 64, 66 of the backing layer 62. In the preferred embodiment, a layer of abrasive particles 42 is adhered to all four major surfaces 64, 66, 70, 72. A layer of abrasive particles 42 can optionally be adhered to the side surfaces 76, 78. Outer surfaces 64A, 66A, 70A, 72A, 76A, 78A of the corner sanding sponge 60 are defined by the ends of the abrasive particles 42 adhered to the corresponding surfaces 64, 66, 70, 72, 76, 78 of the backing layer 22.

If the side surface 78 is coated with abrasive particles 42, it can advantageously be used to abrade curved surfaces. The major and minor axes 50, 52 of the corner sanding sponge 60 are generally as discussed in connection with FIG. 1.

Figure 9:
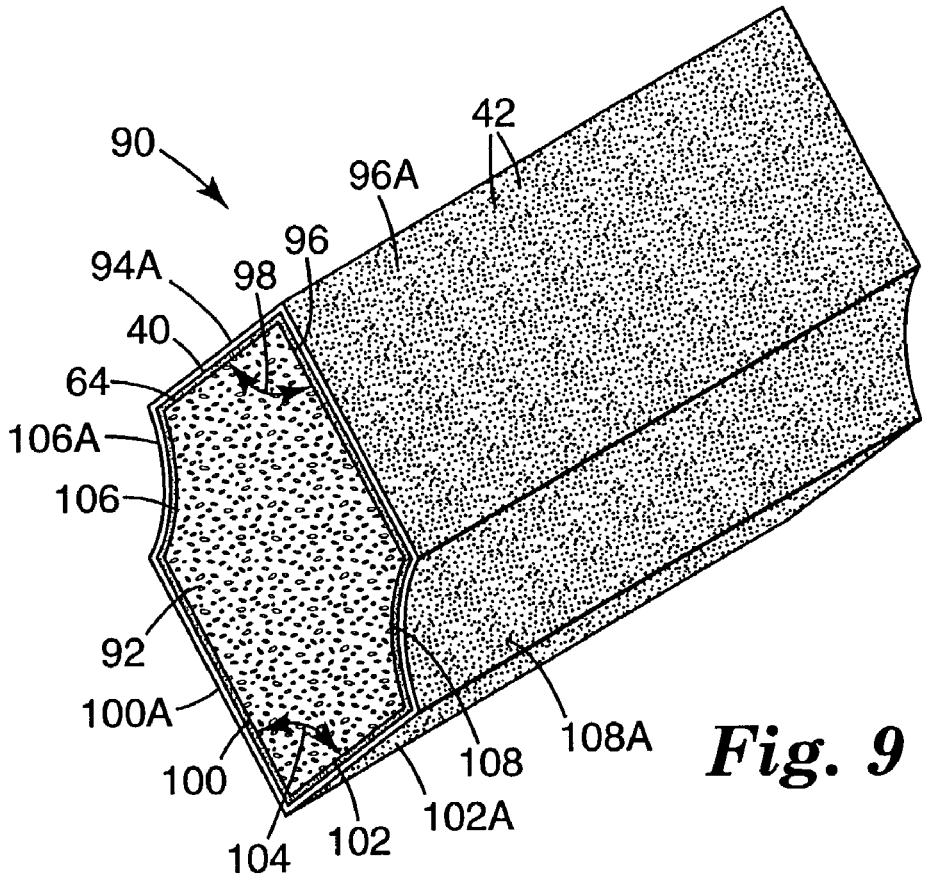
FIG. 9 is a perspective view of a third embodiment of a corner sanding sponge according to the present invention.
Figure 10:
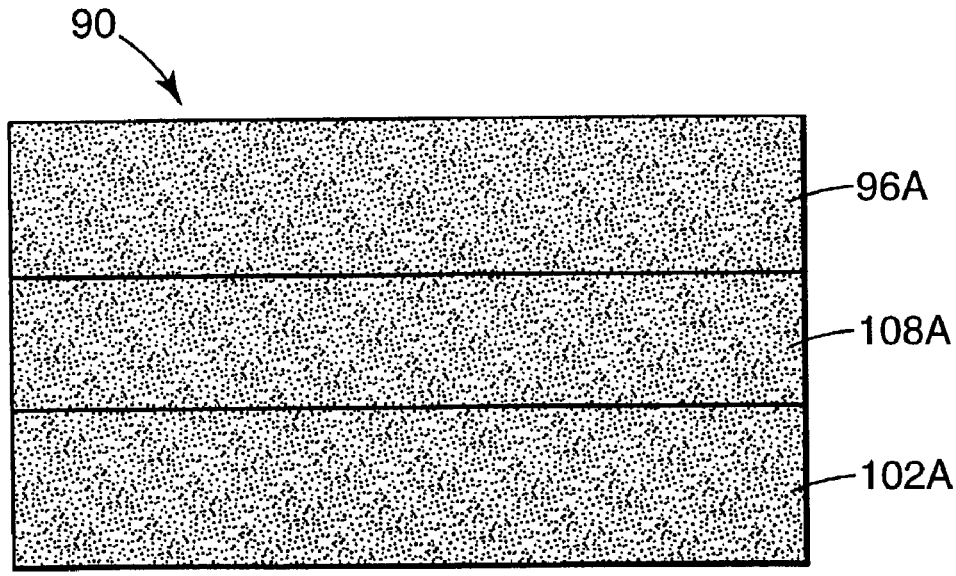
FIG. 10 is a side plan view of the sanding sponge of FIG. 9.
Figure 11:
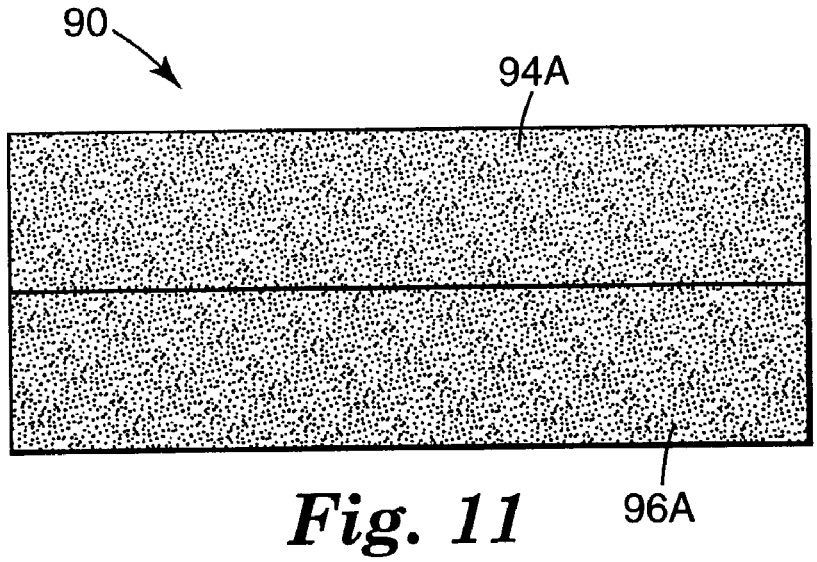
FIG. 11 is a top plan view of the sanding sponge of FIG. 9.
Figure 12:
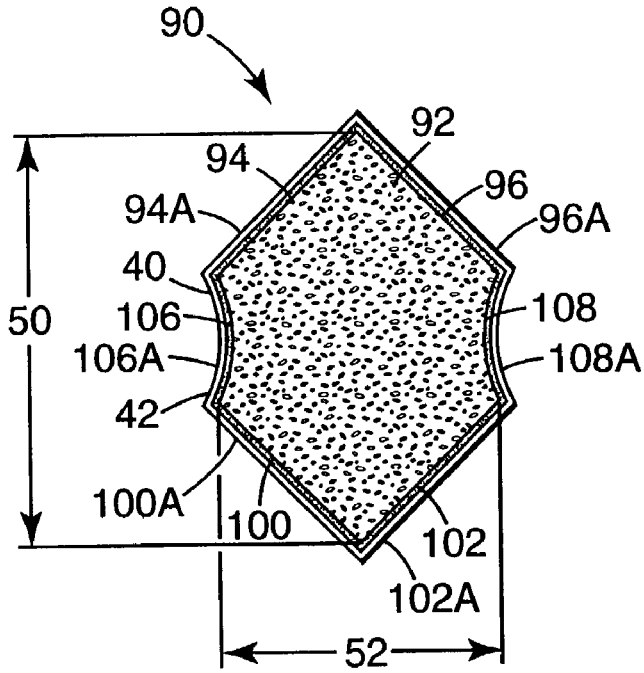
FIG. 12 is an end plan view of the sanding sponge of FIG. 9.

FIGS. 9-12 illustrate a second embodiment of the corner sanding sponge 90 of the present invention. Backing layer 92 is configured to have a first pair of major surfaces 94, 96 that meet at a right angle 98 and a second pair of major surfaces 100, 102 that meet at a right angle 104. A pair of opposing side surfaces 106, 108 are located between the pairs of major surfaces 94, 96 and 100, 102 as in FIG. 1, except that both side surfaces 106, 108 are convex If an imaginary line is drawn between the corners 110A, 112A or 110B, 112B along the edges of the side surfaces 106, 108, the cross section of the sanding sponge 90 is generally hexagonal.

The flexible adhesive 40 is used to adhere the layer of abrasive particles 42 to at least the major surfaces 94, 96 of the backing layer 62. In the preferred embodiment, a layer of abrasive particles 42 is adhered to all four major surfaces 94, 96, 100, 102. A layer of abrasive particles 42 can optionally be adhered to the side surfaces 106, 108. Outer surfaces 94A, 96A, 100A, 102A, 106A, 108A of the corner sanding sponge 90 are defined by the ends of the abrasive particles 42 adhered to the corresponding surfaces 94, 96, 100, 102, 106, 108 of the backing layer 92.

If the one or more of the side surfaces 106, 108 are coated with abrasive particles 42, it can advantageously be used to abrade curved surfaces. The major and minor axes 50, 52 of the corner sanding sponge 90 are generally as discussed in connection with FIG. 1.

All of the patents and patent applications disclosed herein, including those set forth in the Background of the Invention, are hereby incorporated by reference. Although specific embodiments of this invention have been shown and described herein, it is to be understood that these embodiments are merely illustrative of the many possible specific arrangements that can be devised in application of the principles of the invention. Numerous and varied other arrangements can be devised in accordance with these principles by those of ordinary skill in the art without departing from the scope and spirit of the invention. Thus, the scope of the present invention should not be limited to the structures described in this application, but only by the structures described by the language of the claims and the equivalents of those structures.

What is claimed is:

1. A hand held sanding sponge comprising:

a backing layer of an open-celled foam material having first and second major surfaces that meet at a right angle and third and fourth major surfaces that meet at a right angle, the cross-sectional dimension between the intersection of the first and second major surfaces from the intersection of the third and fourth major surfaces being about 4 inches to about 6 inches;

first and second side surfaces located between the first and second major surfaces and the third and fourth major surfaces forming a generally hexagonal shape, the cross-sectional dimension between the first and second side surfaces being about 3 inches to about 4 inches;

a layer of flexible adhesive adhered to at least the first and second major surfaces of the backing layer; and a layer of abrasive particles adhered to the major surfaces by the flexible adhesive.

2. The corner sanding sponge of claim 1 wherein the layer of flexible adhesive and layer of abrasive particles extends along at least one of the first and second side surfaces.

3. The corner sanding sponge of claim 1 wherein the layer of flexible adhesive and the layer of abrasive particles extends along both of the first and second side surfaces.

4. The corner sanding sponge of claim 1 wherein at least one of the first and second side surfaces comprises a concave cross-sectional shape.

5. The corner sanding sponge of claim 1 wherein the first and second side surfaces both comprise a concave cross-sectional shape.

6. The corner sanding sponge of claim 1 wherein the layer of flexible adhesive comprises a major portion below the major surfaces of the backing layer and a minor portion comprising meniscuses of the adhesive around the abrasive particles, thereby exposing a high percentage of the abrasive particles for contact with a surface to be abraded.

7. The corner sanding sponge of claim wherein the cross-sectional dimension between the intersection of the first and second major surfaces from the intersection of the third and fourth major surfaces is about 5 inches.

8. The corner sanding sponge of claim 1 wherein the cross-sectional dimension between the first and second side surfaces is about 3½ inches.

9. The corner sanding sponge of claim 1 wherein the backing layer comprises a felted foam.

10. The corner sanding sponge of claim 1 wherein each of said first, second, third and fourth major surfaces is provided with a layer of flexible adhesive and a layer of abrasive particles, and each of said first and second side surfaces is free of adhesive and abrasive particles.

11. The hand held sanding sponge of claim 1 wherein a surface area of each major surface is greater than a surface area of each side surface.

12. The hand held sanding sponge of claim 1 wherein the backing layer is continuous between the first and second major surfaces and the third and fourth major surfaces.

13. The hand held sanding sponge of claim 1 wherein a length of the first side surface from the first major surface to the second major surface and a length of the second side surface from the third major surface to the fourth major surface are each not less than approximately 1 inch to provide a region sized for grasping by a human hand.

14. The hand held sanding sponge of claim 1 wherein each of the major surfaces and the side surfaces are flat.

15. The hand held sanding sponge of claim 1 wherein the foam material is a synthetic foam.

16. The hand held sponge of claim 1 wherein the foam is a polyurethane foam.

* * * * *

UNITED STATES PATENT AND TRADEMARK OFFICE

CERTIFICATE OF CORRECTION

PATENT NO. : 7,621,802 B2
APPLICATION NO. : 10/227713
DATED : November 24, 2009
INVENTOR(S) : Kevin J. McCarthy It is certified that error appears in the above-identified patent and that said Letters Patent is hereby corrected as shown below:

Title Page 2

Column 2; Other Publications
Line 11; delete "literture," and insert -- literature, --, therefor.

Column 7

Line 23; Claim 7, delete "claim" and insert -- claim 1 --, therefor.

Signed and Sealed this

Twenty-third Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,621,802 B2
APPLICATION NO. : 10/227713
DATED : November 24, 2009
INVENTOR(S) : Kevin J. McCarthy It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 462 days.

Signed and Sealed this

Twenty-sixth Day of October, 2010

David J. Kappos

David J. Kappos
*Director of the United States Patent and Trademark Office*